US005546905A

United States Patent [19]

Fukui

[11] Patent Number: 5,546,905

[45] Date of Patent: Aug. 20, 1996

[54] CONTROL APPARATUS FOR CONTROLLING THE IGNITION TIMING OF AN INTERNAL COMBUSTION ENGINE

[75] Inventor: Wataru Fukui, Himeji, Japan

[73] Assignee: Mitsubishi Denki Kabushiki Kaisha, Tokyo, Japan

[21] Appl. No.: 149,953

[22] Filed: Nov. 10, 1993

[30] Foreign Application Priority Data

Nov. 16, 1992 [JP] Japan ..... 4-305547

[51] Int. Cl.[6] ..... F02P 5/14

[52] U.S. Cl. ..... 123/25

[58] Field of Search ..... 123/425, 332, 123/333, 335, 340, 416, 417, 480, 481, 630, 609, 625

[56] References Cited

U.S. PATENT DOCUMENTS

| | | | |
|---|---|---|---|
| 4,434,779 | 3/1984 | Yamamoto et al. | 123/609 |
| 4,892,073 | 1/1990 | Yamamoto et al. | 123/417 |
| 4,915,086 | 4/1990 | Ciliberto et al. | 123/625 |
| 4,969,443 | 11/1990 | De Biasi | 123/481 |
| 5,043,900 | 8/1991 | Allen et al. | 123/609 |
| 5,139,004 | 8/1992 | Gose et al. | 123/609 |
| 5,143,553 | 9/1992 | Mukaihira et al. | 123/609 |
| 5,148,791 | 9/1992 | Nagano et al. | 123/417 |
| 5,213,178 | 5/1993 | Polidan et al. | 180/197 |
| 5,309,888 | 5/1994 | Deutsch et al. | 123/609 |
| 5,327,867 | 7/1994 | Hisaki et al. | 123/406 |

*Primary Examiner*—Raymond A. Nelli

*Attorney, Agent, or Firm*—Sughrue, Mion, Zinn, Macpeak & Seas

[57] ABSTRACT

In a multi-cylinder internal combustion engine, an ignition control apparatus for suppressing generation of high-level noise and voltage leakage due to unwanted increases; in spark plug demand voltage. The apparatus includes (i) an angular position signal generator for generating a predetermined angular position signal for each of the cylinders in dependence on the rotation speed of the engine, (ii) sensors for detecting relevant operation states of the engine, (iii) fuel injectors for injecting fuel into the cylinders, (iv) an ignition system for firing a fuel mixture within each of the cylinders, and (v) a controller for generating a fuel injection signal for the fuel injectors and an ignition timing signal for the ignition system. These two signals generated by the controller are generated on the basis of the angular position signal and the engine operation state signal. In accordance with the invention, the controller controls the ignition timing so that, for any cylinder for which application of the fuel injection signal is suppressed, the ignition timing is shifted by a period corresponding to a predetermined crank angle from a top dead center position of the cylinder. Alternatively, the controller can be so designed that the duration of electrical conduction through the ignition coil is controlled by the controller to not exceed a predetermined value for the cylinder for which application of the fuel injection signal is suppressed.

28 Claims, 5 Drawing Sheets

CONTROL APPARATUS FOR CONTROLLING THE IGNITION TIMING OF AN INTERNAL COMBUSTION ENGINE

BACKGROUND OF THE INVENTION

1. Field of the Invention

The present invention generally relates to a control apparatus for an internal combustion engine equipped with a fuel injection cut-off function which is triggered, for example, whenever a traction control function of the origins becomes active. More particularly, the invention is concerned with an ignition control apparatus for controlling a demand voltage of a spark plug to thereby prevent generation of high-level noise and protect circuit components of the ignition system from being damaged due to rises in the spark plug demand voltage.

2. Description of the Related Art

In general, in internal combustion engines (hereinafter also referred to simply as the engine) for automobiles or the like, it is required to control optimally the fuel injection and the ignition timing on the basis of the running or operation state of the engine. To this end, a microcomputer-based control apparatus is employed which detects a reference angular position of the crank shaft for each of the engine cylinders. This information is used to control the amount of fuel injected and the ignition timing relative to the reference angular position by using a timer in accordance with the relevant quantities calculated or arithmetically determined on the basis of the engine operation state.

Related to this, it is noted that modern automobiles or motor vehicles are increasingly equipped with a traction control capability for suppressing the engine output torque, with a view to preventing overrun, slippage on a frozen road or similar unwanted events. The torque control may be realized by stopping supply of the ignition signal to the igniter for the cylinder under control. However, in order to prevent fuel wastage as well as discharge of unburned fuel mixture into the atmosphere, it is preferred to adopt a torque control which is based on the cut-off or interruption of the fuel injection.

FIG. 7 is a block diagram showing a conventional control apparatus designed, for example, for a four-cylinder internal combustion engine in which the fuel supply to the engine is realized through fuel injection and the ignition control is realized by distributing a high voltage to spark plugs of the individual cylinders, respectively. Referring to the figure, an angular position signal generating means 1 is provided in association with a rotatable shaft of the engine, such as a crank shaft, cam shaft or the like. The generating means 1 generates an angular position signal T at every predetermined reference angular position of the crank shaft as the engine operates. To this end, the angular position signal generating means 1 may be constituted by an electromagnetic pick-up device disposed in opposition to a disk mounted on the crank shaft or cam shaft for rotation therewith and having a projection formed in the periphery of the disk, which projection passes by the electromagnetic pick-up device as the crank or cam shaft rotates. Alternately, the angular position signal generating means 1 may be implemented in the form of a photoarray disposed in opposition to slits formed in the disk mentioned above. In any case, the angular position signal T contains the reference position information for the angular positions of the crank shaft as well as the cylinder identification information.

For detecting the engine operation states, there are provided a variety of sensors denoted representatively in FIG. 7 by reference numeral 2. These sensors 2 detect engine operation states such as engine load, temperature etc. The detection signals outputted by these sensors 2, will hereinafter be referred to as the engine operation state signal and designated generally by a reference character D.

The angular position signal T and the engine operation state signal D are supplied to a control means 4 which is constituted by a microcomputer for controlling the operation of the engine on the basis of these signals T and D. More specifically, the control means 4 detects or identifies the reference positions for the individual cylinders from the angular position signal T and arithmetically determines or calculates the fuel injection quantity and the ignition timing on the basis of the engine operation state D to thereby output control signals J and Q for the fuel injection and the ignition timing, respectively.

Connected to the outputs of the control means 4 are fuel injectors 5 for injecting the fuel mixture into the associated cylinders, respectively, in response to the fuel injection signal J and an ignition coil 6 driven by the ignition timing signal Q. A distributor 7 is connected to a secondary winding of the ignition coil 6 and has output terminals connected to spark plugs 8 of the individual cylinders, respectively. When electrical conduction through a primary winding of the ignition coil 6 is interrupted in response to the ignition timing signal Q, a high voltage is induced in the secondary winding of the ignition coil 6 and applied to the spark plug 8 of the associated cylinder for firing the fuel mixture therein through the electric discharge of the spark plug 8.

The control means 4 includes input interfaces 41 and 42 for fetching the angular position signal T and the engine operation state signal D, respectively. It further includes a fuel control unit 43 for arithmetically determining or calculating the fuel injection quantity for each cylinder on the basis of the angular position signal T and the engine operation state signal D, and an ignition control unit 44 for calculating the ignition timing for each cylinder, again on the basis of the angular position signal T and the engine operation state signal D. The control means 4 also includes an output interface 45 for applying the fuel injection signal J indicative of the fuel injection quantity as calculated to the fuel injector 5, and an output interface 46 for applying the ignition timing signal Q corresponding to the ignition timing as calculated to the ignition coil 6.

Next, operation of the conventional engine control apparatus will be described by reference to FIG. 7.

As the engine rotates the angular position signal generating means 1 generates the angular position signal T indicative of the reference position. This signal T is then inputted to the fuel control unit 43 and the ignition control unit 44 incorporated in the control means 4 via the input interface 41. The various sensors 2 detect the engine operation states, whereby the engine operation state signal D is inputted to the ignition control unit 44 of the control means 4 via the input interface 42.

The fuel control unit 43 detects the reference position for each cylinder on the basis of the angular position signal T and arithmetically determines the fuel injection quantity as well as the fuel injection timing on the basis of the engine operation state signal D to thereby generate the fuel injection signal J corresponding to the calculated fuel injection quantity. Signal J is applied to the fuel injector 5 via the output interface 45. On the other hand, the ignition control unit 44 detects the reference position for each cylinder from the angular position signal T and calculates the ignition timing conforming to the engine operation state indicated by the signal D to thereby generate the ignition timing signal Q indicative of the calculated ignition timing, which signal Q is then applied to the ignition coil 6 via the output interface 46.

At this point in time, a timer control starts from a reference position determined on the basis of the angular point signal T. More specifically, the fuel injectors 5 are sequentially driven, whereby the fuel mixture is injected to the respective cylinders. Further, interruptions of the electrical conduction through the ignition coil 6 bring about electric discharges sequentially between a rotating center electrode and stationary peripheral electrodes of the distributor 7, which results in generation of sparks in the spark plugs 8 in a sequential manner, whereby the individual cylinders under control are fired correspondingly.

However, when the traction control mentioned previously is triggered, the fuel injection signal J to the fuel injector 5 associated with the cylinder for which the traction control is to be effected is inhibited, whereby the fuel supply to that fuel injector 5 is cut off. On the other hand, the ignition control unit 44 continues to generate the ignition timing signal Q. In conjunction with this, it has been observed that although the demand voltage of the spark plug 8 (i.e., the voltage required for the electric discharge to take place in the spark plug) in the normal fuel injection mode lies within a range of 10 kV to 20 kV, the demand voltage may rise to a range of 20 kV to 30 kV when the fuel supply to the cylinder associated with the spark plug 8 is cut off. The reason why the spark plug demand voltage increases when the fuel injection is cut off may be explained as follows. When the cylinder continues to remain in the state where the fuel injection is interrupted, temperature within the cylinder decreases, as a result of which emission of thermions from the cathode electrode of the spark plug 8 decreases. At the same time, the cylinder pressure rises abnormally during the compression stroke due to increase in the air density or concentration.

In particular, in the case where the ignition timing is set in the vicinity of the top dead center (TDC), the increase in cylinder pressure during the compression stroke as well as that of the spark plug demand voltage can no longer be neglected.

Parenthetically, it should be added that fuel injection is also interrupted in an engine deceleration region, where the throttle valve is fully closed, because no output torque is demanded when the throttle valve is fully closed.

Moreover, such a rise of in the cylinder pressure is also observed when an abnormality occurs in the pressure control for a supercharger employed in a turbo-engine. In general, in turbo-engines, the intake air quantity is increased by using the supercharger in order to make available the output torque which is in excess of the stroke volume or cylinder capacity, wherein a fail-safe mechanism is provided for preventing the cylinder pressure from increasing beyond an upper limit value. Accordingly, when failure or abnormality occurs in the fail-safe mechanism, there exists a high probability of the cylinder pressure increasing abnormally.

When the voltage demand of the ignition plug 8 becomes high for the reasons mentioned above, serious problems arise, such as generation of high level electric noise injury or damage to the distributor 7, the spark plug 8 and/or other circuit components due to leakage of the abnormally high voltage. To protect the circuit components against damage from the voltage leakage, it is conceivable to increase the voltage withstanding capabilities of the individual circuit components. This is however undesirable because it necessitates implementing the whole system in a larger scale whereby additional expenditures are incurred.

As will now be appreciated from the foregoing, the engine control apparatus known heretofore suffers from problems including the generation of electric noise an unacceptably high level, and injury or damage to the distributor 7, the spark plug 8 and the like circuit components due to leakage of abnormally high voltage. In other words, no measures have been adopted for coping with the rise in spark plug demand voltage ascribable to the cut-off of fuel injection in the traction control or ascribable to failure in the failsafe mechanism in the case of the turbo-engine.

SUMMARY OF THE INVENTION

In light of the state of the art described above, it is an object of the present invention to provide an engine control apparatus in which generation of electric noise and voltage leak due to a rise in the demand voltage of the spark plug can be prevented.

In view of the above and other objects which will become apparent as description proceeds, there is provided, according to are aspect of the present invention, a control apparatus for an internal combustion engine having a plurality of cylinders, which apparatus comprises (i) an angular position signal generating means for generating a predetermined angular position signal for each of the cylinders in dependence upon rotation speed of the engine, (ii)sensor means for detecting an operation state of the engine, (iii) fuel injection means for injecting fuel into each of the cylinders, (iv) an ignition coil means for firing a fuel mixture within each of the cylinders, and (v) a control means for generating a fuel injection signal for the fuel injection means and an ignition timing signal for the ignition coil means. The signals are generated on the basis of the angular position signal and the engine operation state as detected, whereby the control means controls the ignition timing signal so that, for a particular cylinder for which application of the fuel injection signal is stopped, ignition timing is shifted by a period corresponding to a predetermined crank angle from a top dead center position of the particular cylinder.

In an engine control apparatus according to another aspect of the invention, the control means mentioned above may be so designed as to control the ignition coil means so that the duration of the electrical conduction through the ignition coil does not exceed a value predetermined for the cylinder for which application of the fuel injection signal is stopped.

According to yet another aspect of the invention, there is provided a control apparatus for an internal combustion engine having a plurality of cylinders, which apparatus comprises (i) an angular position signal generating means for generating a predetermined angular position signal for each of the cylinders in dependence upon rotation speed of the engine, (ii) a cylinder pressure sensor means for detecting pressure within each of the cylinders, (iii) sensor means for detecting an operation state of the engine, (iv) fuel injection means for injecting fuel into each of the cylinders, (v) an ignition coil means for firing a fuel mixture within each of the cylinders, and (vi) a control means for generating an ignition timing signal for the ignition coil means. This signal is generated on the basis of the angular position signal, the cylinder pressure signal and the engine operation state signal, whereby the control means controls the ignition timing signal so that, for a particular cylinder for which the cylinder pressure is higher than a predetermined value, the ignition timing is shifted by a period corresponding to a predetermined crank angle from a top dead center position of the particular cylinder.

Further, in an engine control apparatus according to still another aspect of the invention, the control means mentioned above may be so designed as to control the ignition timing signal so that the duration of the electrical conduction through the ignition coil does not exceed a value predetermined for the cylinder for which application of the fuel injection signal is stopped.

With the structures of the engine control apparatus described above, the ignition timing can be so controlled that, for any cylinder for which the fuel supply is cut off, the ignition or firing takes place during a period in which the pressure within that cylinder is low. By virtue of this feature, the demand voltage of the spark plug can be suppressed to a low level, whereby generation of high level electric noise and damage to the circuit components mentioned hereinbefore can effectively be prevented. Further, similar effects can be achieved by controlling the ignition coil such that the duration of the electrical conduction through the ignition coil is shortened, to thereby suppress generation of the secondary voltage from the ignition coil for the cylinder whose pressure is higher than a predetermined level.

The above and other objects, features and attendant advantages of the present invention will more easily be understood by reading the following description of the preferred embodiments thereof, in conjunction with the drawings.

DESCRIPTION OF THE PREFERRED EMBODIMENTS

Now, the present invention will be described in detail in conjunction with preferred or exemplary embodiments thereof by reference to the drawings.

Embodiment 1

Figure 1:
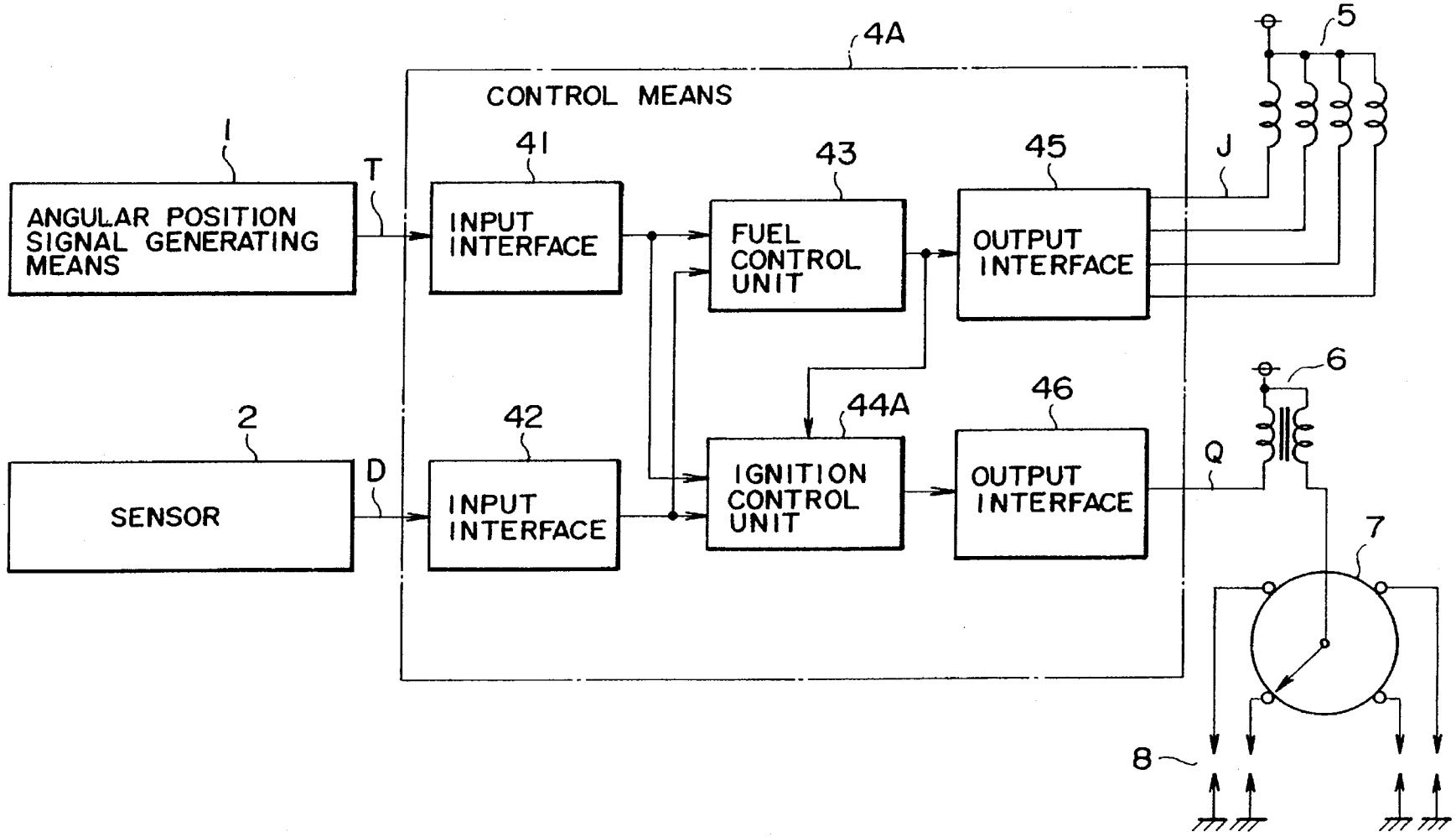
FIG. 1 is a functional block diagram showing a general arrangement of a control apparatus for an internal combustion engine according to a first embodiment of the present invention.

FIG. 1 is a block diagram showing a general arrangement of a control apparatus for an internal combustion engine according to a first embodiment of the invention. In the figure, those components or parts which are the same as or equivalent to those described hereinbefore in conjunction with the related art illustrated in FIG. 7 are denoted by like reference numerals, and repeated description thereof is omitted.

Figure 7:
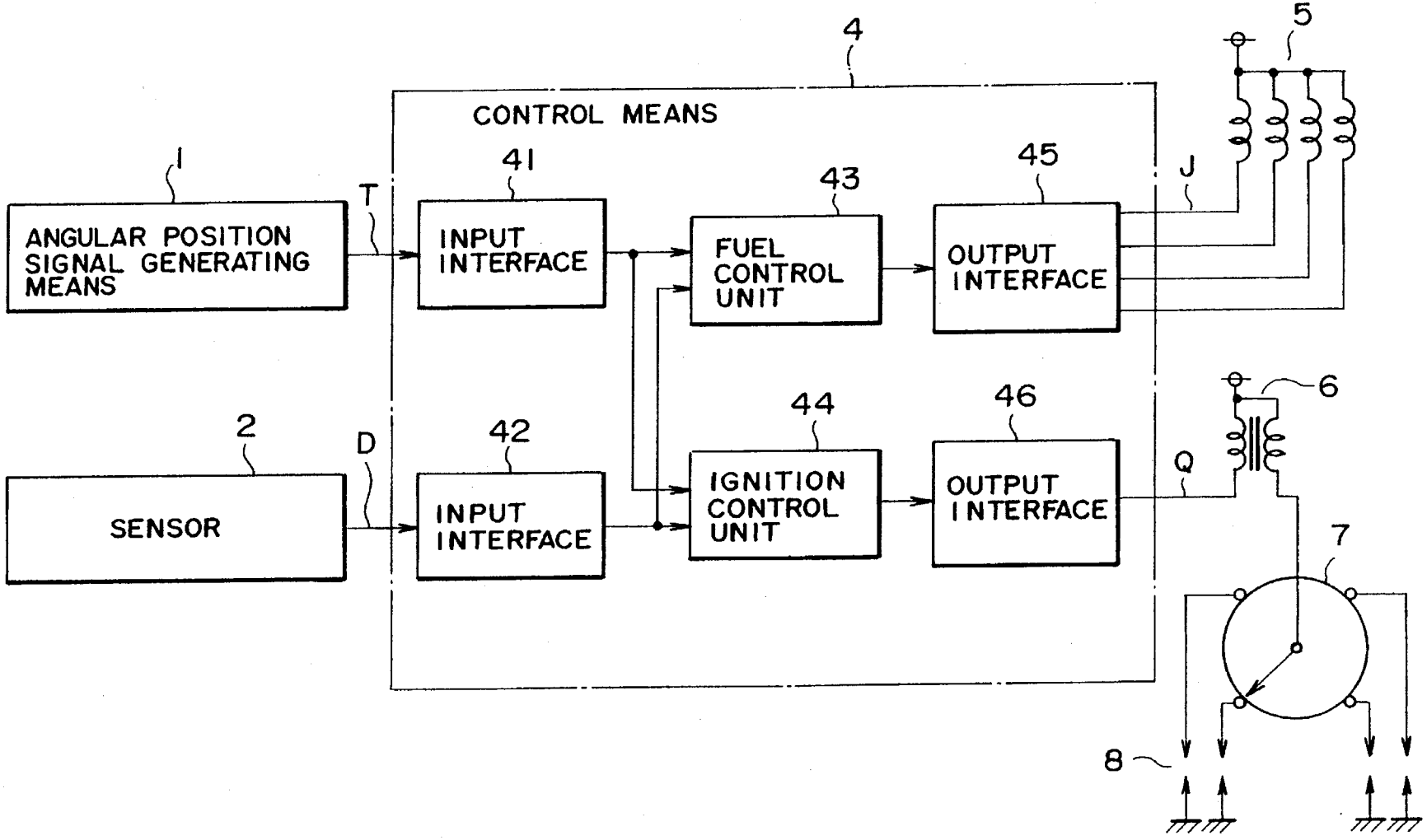
FIG. 7 is a block diagram showing a conventional engine control apparatus.

Referring to FIG. 1, the ignition control unit 44A corresponds to the one denoted by reference numeral 44 in FIG. 7, while the control means 4A corresponds to that denoted by numeral 4 in FIG. 7. The ignition control unit 44A is designed to modify the ignition timing signal Q in response to the fuel injection signal J so that the timing for firing the fuel mixture within the cylinder for which the fuel injection signal J is suppressed is deviated or shifted from the top dead center of that cylinder by a period which corresponds to a predetermined crank angle.

Figure 2:
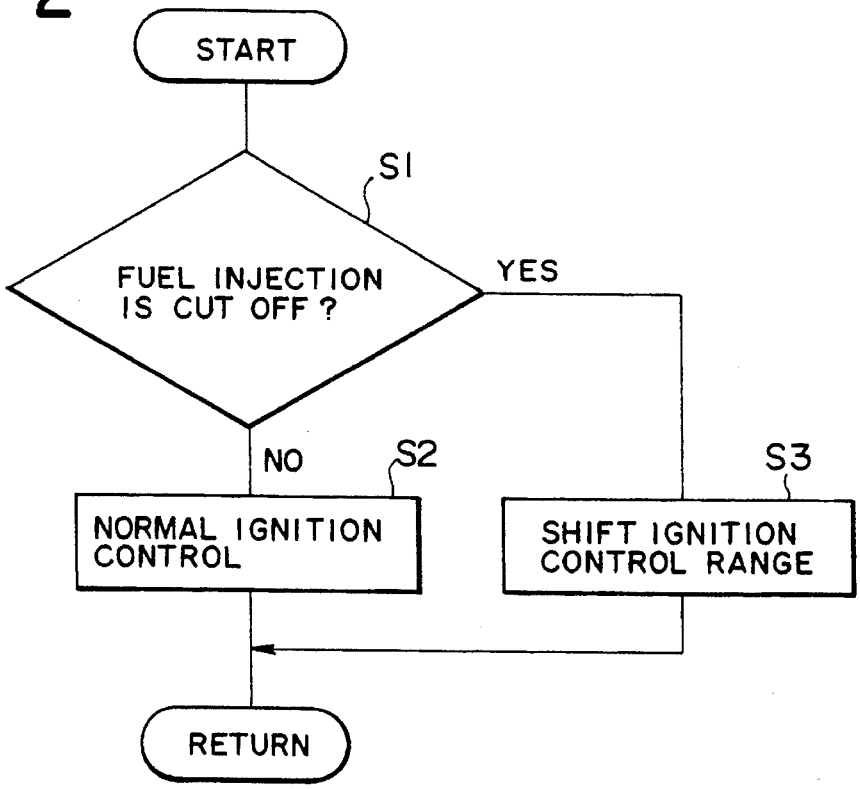
FIG. 2 is a flow chart for illustrating operations of the control apparatus according to the first embodiment of the invention.

FIG. 2 is a flow chart for illustrating operation of the control means 4A and the control unit 44A.

As described hereinbefore, when the engine rotates, the angular position signal generating means 1 generates the angular position signal T, while the engine operation state is detected by the various sensors 2. The angular position signal T and the engine operation state signal D are inputted to the fuel control unit 43 and the ignition control unit 44A incorporated in the ignition control unit 44 via the input interfaces 41 and 42, respectively.

The fuel control unit 43 arithmetically determines or calculates the fuel injection timing and the amount of fuel to be injected based on the engine operation state detected. The fuel injection signal J is thereby generated and applied to the fuel injector 5 provided in association with each of the engine cylinders. On the other hand, the ignition control unit 44A calculates the duration of electrical conduction through the ignition coil 6 and the ignition timing in dependence on the engine operation state signal D and the angular position signal T to thereby generate the ignition timing signal Q which is then applied to the ignition coil 6.

In the normal operation state, the fuel injection is not cut off. Thus, the fuel injectors 5 are driven by the fuel injection signals J to charge the fuel mixture into the associated cylinders. Thus, the answer of a decision step S1 shown in FIG. 2 for deciding whether the fuel injection is cut off is negative (NO). Consequently, the ordinary ignition control described hereinbefore is performed (step S2), whereupon the processing comes to an end (RETURN).

Now, let's assume that the traction control is put into effect. In that case, the fuel injection signal J is not generated by the fuel control unit 43. Consequently, the ignition control unit 44A decides that the relevant cylinder (i.e., the cylinder for which the fuel injection signal J is not generated) is in the state in which the fuel injection is cut off or interrupted (step S1). Thus, the ordinary ignition control step S2 is invalidated and an ignition timing shift step S3 is executed, whereupon the processing comes to an end.

In the step S3, the ignition timing is so set that the firing for the cylinder for which the fuel injection is cut takes place at an angular position differing from the TDC by a predetermined crank angle rather than at the normal ignition timing set in the vicinity of the TDC. More specifically, when the fuel injection is cut off for a given one of the cylinders, the ignition timing for that cylinder is so set as to fall within a crank angle range which does not cover a range of B40° CA. (indicating 40° before the TDC in terms of the crank angle) to A40° CA. (indicating 40° after the TDC). The setting or change of the fuel injection range as mentioned above can be realized by resorting to a timer or counter as is well known in the art. Thus, the ignition timing signal Q is generated at a time point which is shifted at least by a time span which corresponds to 40° CA. from the TDC, whereby firing in the vicinity of the TDC can be evaded. In this manner, the ignition or firing signal for the cylinder for which the fuel injection is cut off is generated at a position corresponding to a crank angle preceding or following the TDC at least by 40° CA. As a result, electric discharge takes place at the associated spark plug during a state in which the cylinder pressure is low enough to lower the demand voltage of the associated spark plug 8 to a level at which neither the high level electric noise nor leakage of abnormally high voltage can take place.

At this juncture, it should be mentioned that the predetermined crank angle for avoiding the ignition or firing in the vicinity of the TDC is not restricted to B40° CA. or A40° CA. but may be selected to be greater than these values. When the ignition timing is set at a crank angle greater than A40° CA., the gas mixture remaining unburned within the cylinder at the point in time at which the fuel injection to that cylinder is cut off can nonetheless undergo combustion triggered at the delayed ignition timing. Thereby, the reliability of the ignition system can be enhanced, with knocking or similar unwanted phenomenon being positively suppressed.

Although the foregoing description has been made on the assumption that the engine is a four-cylinder engine, the teachings of the invention can equally be applied to the engines having any other number of cylinders.

Embodiment 2

In the case of the control apparatus according to the first embodiment, the rise in of the demand voltage of the spark plug 8 is suppressed by shifting the ignition timing. According to the teachings of the invention in its second embodiment, it is proposed to suppress the secondary output voltage of the ignition coil 6 by controlling the duration of electrical conduction through the ignition coil.

Figure 3:
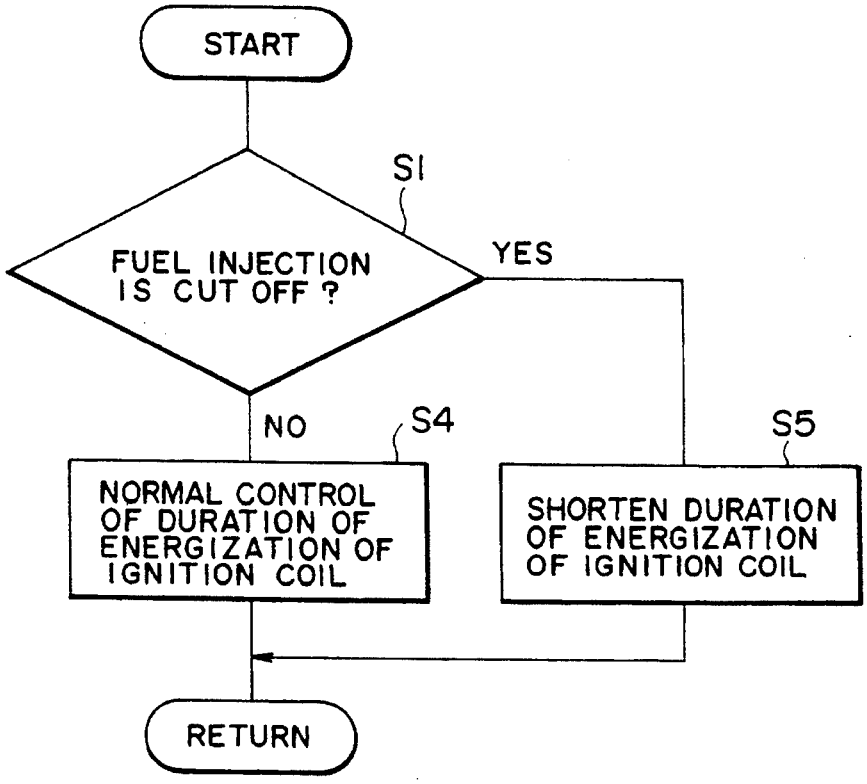
FIG. 3 is a flow chart for illustrating operation of the control apparatus according to a second embodiment of the invention.

FIG. 3 is a flow chart for illustrating operation of the control apparatus according to the instant embodiment. Referring to the figure, a determination is made in step S1 as to whether the fuel injection to any one of the engine cylinders is cut off, as in the case of the first embodiment. When the answer is negative (NO), the electric energization of the ignition coil is performed normally (step S4). On the other hand, when step S3 is affirmative (YES), the duration of the electric conduction or energization of the ignition coil is regulated (step S5). More specifically, the duration of the electric energization of the ignition coil as determined by the ignition control unit 44A is multiplied by a correcting coefficient $\alpha$ ($0 \leqq \alpha \leqq 1$) which is so selected as to shorten the duration of energization of the ignition coil, as compared with the duration for normal energization. As a result, generation of the ignition signal Q is delayed, whereby the secondary output voltage of the ignition coil 6 generated upon interruption of energization is suppressed. Thus, even when the demand voltage of the spark plug 8 is abnormally high, the voltage actually applied to the spark plug 8 is prevented from rising up. This, in turn, satisfactorily suppresses leakage of abnormally high voltages as well as generation of high-level noise.

As a modification of the step S5, the duration of energization of the ignition coil may be set to a predetermined value instead of the calculated value. In an extreme case, the predetermined value may be zero, indicating that electrical energization is omitted altogether.

Embodiment 3

In the case of the first and second embodiments, determinations are made as to whether or not the fuel injection signal J is generated, i.e., whether or not the fuel injection is cut off. However, rises in the demand voltage of the spark plug 8 may be determined also on the basis of the cylinder pressure. The third embodiment of the invention is based on this concept.

Figure 4:
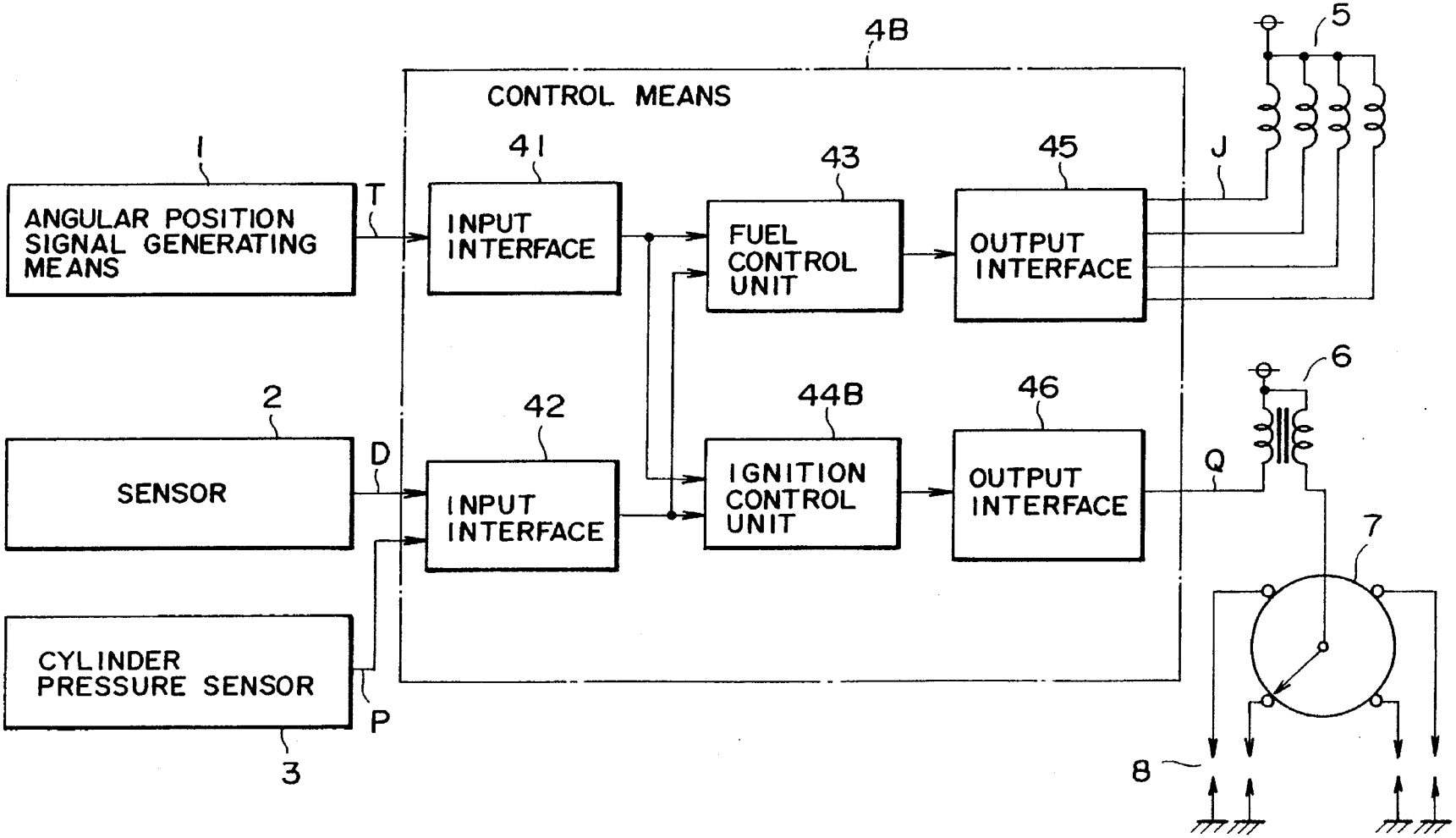
FIG. 4 is a functional block diagram of a control apparatus according to a third embodiment of the invention.

FIG. 4 is a functional block diagram of the control apparatus according to the third embodiment of the invention. In the figure, components that are the same as or equivalent to those shown in FIGS. 1 and 7 are denoted by like reference numerals and repeated description thereof is omitted. Control means 4B and ignition control unit 44B correspond to those designated by 4A and 44A, respectively, in FIG. 1. The control apparatus according to the third embodiment includes cylinder pressure sensor means 3 for detecting the pressure within the cylinders of the engine, wherein the cylinder pressure P as detected is inputted to the control means 4B via the input interface 42.

Figure 5:
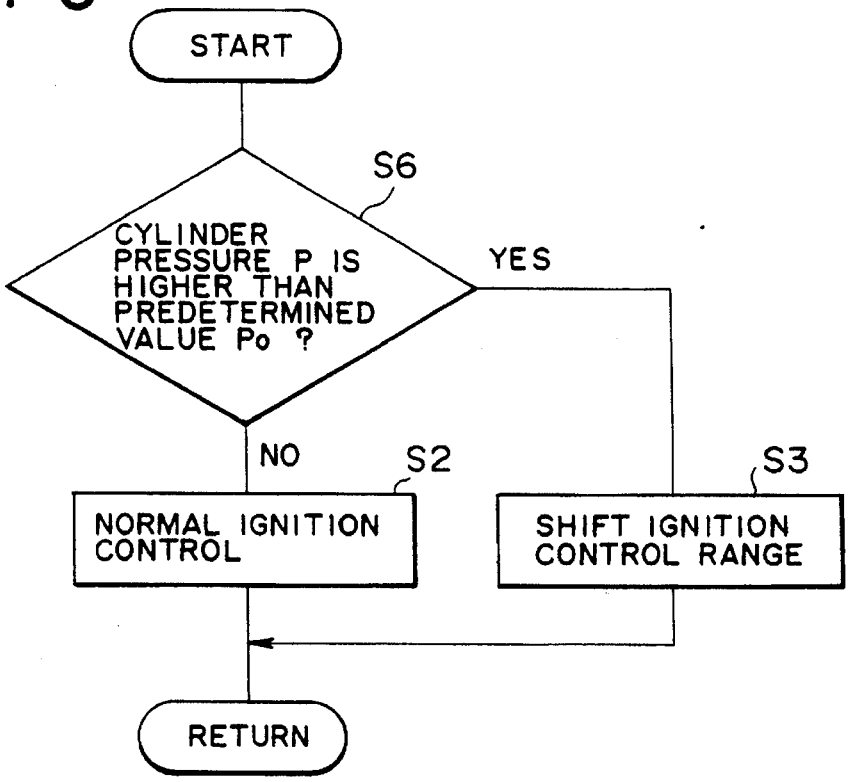
FIG. 5 is a flow chart for illustrating the operation of the control apparatus according to the third embodiment of the invention.

Next, description will turn to operation of the control apparatus according to the instant embodiment by reference to the flow chart of FIG. 5, in which the steps S2 to S3 are similar to those described hereinbefore. Accordingly, the following description will be directed to the steps which are different from those of the first and second embodiments.

In a step S6, it is determined whether the cylinder pressure P as detected is higher than a predetermined value $P_o$. If not, the ordinary ignition control as described earlier is performed (step S2). Otherwise, the ignition control is regulated with respect to the range of ignition timing (step S3), as described hereinbefore. Consequently, when the fuel injection is cut off in any one of the cylinders and the pressure P within that cylinder increases, ignition in the vicinity of the TDC is evaded in order to prevent the demand voltage of the spark plug 8 from rising. Of course, even in the case where the cylinder pressure becomes abnormally high for causes other than the fuel being cut-off, the demand voltage of the spark plug is equally inhibited from rising up. In this manner, the reliability of the ignition system is improved.

Embodiment 4

Figure 6:
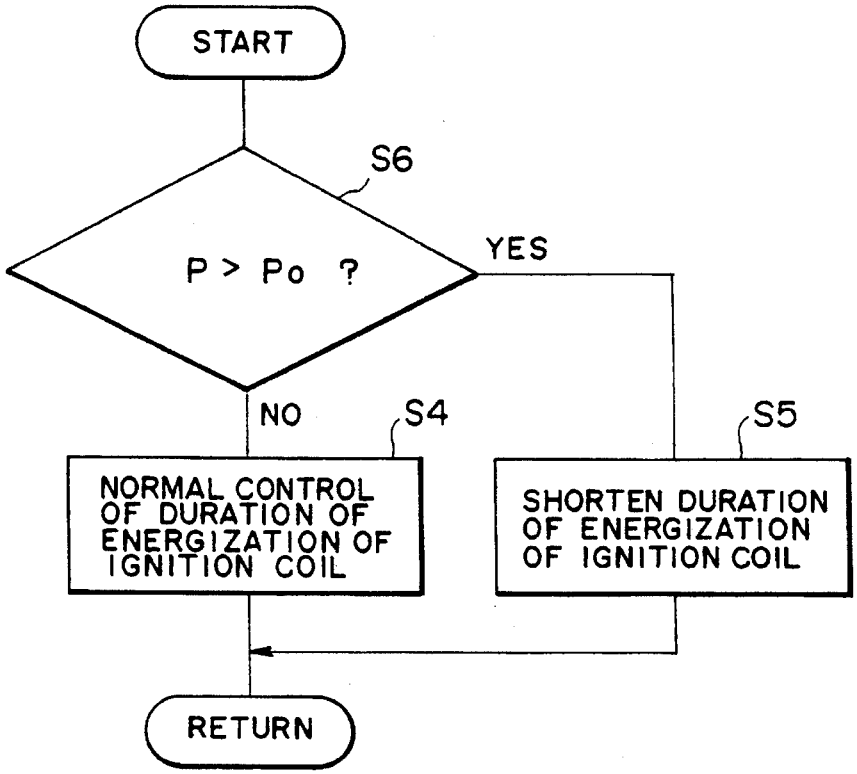
FIG. 6 is a flow chart for illustrating the operation of the control apparatus according to a fourth embodiment of the invention.

FIG. 6 is a flow chart for illustrating the operation of the control apparatus according to a fourth embodiment of the invention. This embodiment corresponds to a modification of the third embodiment. It differs in that, when it is determined that the cylinder pressure P is higher than the predetermined value $P_o$ in step S6, the duration of electrical energization of the ignition coil is regulated in step S5 in the manner described hereinbefore in conjunction with the second embodiment.

Many features and advantages of the present invention are apparent from the detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described. By way of example, although the invention has been described in conjunction with a four-cylinder engine, it should be understood that the invention can equally be applied to the other types of engines, inclusive of the turbo engines equipped with the superchargers as described hereinbefore. Accordingly, all suitable modifications and equivalents falling within the spirit and scope of the invention are intended to be covered.

I claim:

1. A control apparatus for an internal combustion engine that has a plurality of cylinders, comprising:

angular position signal generating means for generating a predetermined angular position signal for each of said cylinders in accordance with a rotation speed of said engine;

sensor means for detecting an operation state of said engine and for generating an engine operation state signal;

fuel injection means for injecting fuel into each of said cylinders;

ignition means for firing a fuel mixture within each of said cylinders; and control means for generating a fuel injection signal for said fuel injection means and an ignition timing signal for said ignition means on the basis of said angular position signal and said engine operation state signal;

wherein said control means controls said ignition timing signal so that, for one of said cylinders for which application of said fuel injection signal ceases, ignition timing is shifted by a period which corresponds to a predetermined crank angle from a top dead center position of said one cylinder.

2. An engine control apparatus according to claim 1, wherein said predetermined crank angle lies outside of a range from 40° before said top dead center to 40° after said top dead center.

3. An engine control apparatus according to claim 1, said engine being equipped with a traction control, wherein said control means controls said ignition timing signal to shift the ignition timing when said traction control is effected.

4. A control apparatus for an internal combustion engine including a plurality of cylinders, comprising:

angular position signal generating means for generating a predetermined angular position signal for each of said cylinders in dependence on a rotation speed of said engine;

sensor means for detecting an operation state of said engine and for generating an engine operation state signal;

fuel injection means for injecting fuel into each of said cylinders;

ignition coil means for firing a fuel mixture within each of said cylinders; and control means for generating a fuel injection signal for said fuel injection means and an ignition timing signal for said ignition coil means on the basis of said angular position signal and said engine operation state signal;

wherein said control means controls ignition dwell time so that a duration of electric conduction through said ignition coil means does not exceed a predetermined value for one of said cylinders for which application of said fuel injection signal is stopped.

5. An engine control apparatus according to claim 4, wherein the duration of said electric conduction is set to zero.

6. An engine control apparatus according to claim 4, wherein said predetermined value corresponds to a normal demand voltage of a spark plug of said cylinder which appears across said spark plug when fuel injection is performed normally for said cylinder.

7. An engine control apparatus according to claim 4, said engine being equipped with a traction control, wherein said control means controls said ignition dwell time to limit the duration of the electric conduction when said traction control is effected.

8. A control apparatus for an internal combustion engine including a plurality of cylinders, comprising:

angular position signal generating means for generating a predetermined angular position signal for each of said cylinders in dependence on a rotation speed of said engine;

cylinder pressure sensor means for generating a cylinder pressure signal in dependence on a cylinder pressure within each of said cylinders;

sensor means for detecting an operation state of said engine;

fuel injection means for injecting fuel into each of said cylinders;

ignition means for firing a fuel mixture within each of said cylinders; and control means for generating an ignition timing signal for said ignition means on the basis of said angular position signal, said cylinder pressure and said engine operation state;

wherein said control means controls said ignition timing signal so that, for one of said cylinders for which said cylinder pressure signal indicates a cylinder pressure higher than a predetermined value, said ignition timing signal is shifted by a period corresponding to a predetermined crank angle from a top dead center position of said one cylinder.

9. An engine control apparatus according to claim 8, wherein said predetermined crank angle lies outside of a range from 40° before said top dead center to 40° after said top dead center.

10. An engine control apparatus according to claim 8, said engine being equipped with a traction control, wherein said control means controls said ignition timing signal to shift the ignition timing when said traction control is effected.

11. A control apparatus for an internal combustion engine including a plurality of cylinders, comprising:

angular position signal generating means for generating a predetermined angular position signal for each of said cylinders in dependence on a rotation speed of said engine;

cylinder pressure sensor means for generating a cylinder pressure signal in dependence on a cylinder pressure within each of said cylinders;

sensor means for detecting an operation state of said engine and for generating an engine operation state signal;

fuel injection means for injecting fuel into each of said cylinders;

ignition coil means for firing a fuel mixture within each of said cylinders; and control means for generating an ignition timing signal for said ignition coil means on the basis of said angular position signal, said cylinder pressure signal and said engine operation state signal;

wherein said control means controls ignition dwell time so that a duration of electric conduction through said ignition coil means does not exceed a predetermined value for one of said cylinders for which said cylinder pressure signal indicates a cylinder pressure higher than a predetermined value.

12. An engine control apparatus according to claim 11, wherein the duration of said electric conduction is set to zero.

13. An engine control apparatus according to claim 11, wherein said predetermined value corresponds to a normal demand voltage of a spark plug of said cylinder which appears across said spark plug when fuel injection is performed normally for said cylinder.

14. An engine control apparatus according to claim 11, said engine being equipped with a traction control, wherein said control means controls said ignition timing signal to limit the duration of the electric conduction when said traction control is effected.

15. A method of controlling ignition timing in an internal combustion engine having a plurality of cylinders, comprising the steps of:

determining whether fuel injection is interrupted to a particular one of the cylinders by determining an absence of a fuel injection signal; and if the fuel injection signal is determined to be absent in said determining step, adjusting timing of an ignition timing signal for the particular cylinder by a period corresponding to a predetermined crank angle from a top dead center position of the particular cylinder.

16. The method of controlling ignition timing according to claim 15, wherein the timing of the ignition timing signal is adjusted in said adjusting step to avoid corresponding with crank angles of less than 40° from the top dead center position.

17. The method of controlling ignition timing according to claim 15, wherein said method is performed for each of the plurality of cylinders in sequence.

18. A method of controlling ignition timing in an internal combustion engine having a plurality of cylinders, comprising the steps of:

determining whether fuel injection is interrupted to a particular one of the cylinders by determining an absence of a fuel injection signal; and if the fuel injection signal is determined to be absent in said determining step, shortening, relative to a normal operating duration, a duration of electric conduction through an ignition coil for the particular cylinder.

19. The method of controlling ignition timing according to claim 18, wherein the duration of the electric conduction is shortened in said shortening step by multiplying the normal operating duration by a correcting coefficient that is greater than or equal to zero but less than one.

20. The method of controlling ignition timing according to claim 18, wherein the duration of the electric conduction is shortened in said shortening step by setting the duration to a predetermined duration that is less than the normal operating duration.

21. The method of controlling ignition timing according to claim 18, wherein said method is performed for each of the plurality of cylinders is sequence.

22. A method of controlling ignition timing in an internal combustion engine having a plurality of cylinders, comprising the steps of:

determining whether a cylinder pressure in one of the cylinders is higher than a predetermined value by evaluating a cylinder pressure signal output by a cylinder pressure sensor; and if the cylinder pressure signal indicates a cylinder pressure higher than the predetermined value in said determining step, adjusting timing of an ignition timing signal for the particular cylinder by a period corresponding to a predetermined crank angle from a top dead center position of the particular cylinder.

23. The method of controlling ignition timing according to claim 22, wherein the timing of the ignition timing signal is adjusted in said adjusting step to avoid corresponding with crank angles of less than 40° from the top dead center position.

24. The method of controlling ignition timing according to claim 22, wherein said method is performed for each of the plurality of cylinders in sequence.

25. A method of controlling ignition timing in an internal combustion engine having a plurality of cylinders, comprising the steps of:

determining whether a cylinder pressure in one of the cylinders is higher than a predetermined value by evaluating a cylinder pressure signal output by a cylinder pressure sensor; and if the cylinder pressure signal indicates a cylinder pressure higher than the predetermined value in said determining step, shortening, relative to a normal operating duration, a duration of electric conduction through an ignition coil for the particular cylinder.

26. The method of controlling ignition timing according to claim 25, wherein the duration of the electric conduction is shortened in said shortening step by multiplying the normal operating duration by a correcting coefficient that is greater than or equal to zero but less than one.

27. The method of controlling ignition timing according to claim 25, wherein the duration of the electric conduction is shortened in said shortening step by setting the duration to a predetermined duration that is less than the normal operating duration.

28. The method of controlling ignition timing according to claim 25, wherein said method is performed for each of the plurality of cylinders in sequence.

* * * * *